US008434279B2

(12) United States Patent
Kim et al.

(10) Patent No.: US 8,434,279 B2
(45) Date of Patent: May 7, 2013

(54) METHOD FOR MANUFACTURING A COMPOSITE BEAM USING T-TYPE STEEL AND METHOD FOR CONSTRUCTING A STRUCTURE USING THE SAME

(75) Inventors: Jeom Han Kim, Gyeonggi-do (KR); Young Sang Cho, Seoul (KR); Eun Ho Jeong, Gyeonggi-do (KR); Kyoung Hun Lee, Gyeonggi-do (KR)

(73) Assignee: Neo Cross Structure Engineering Co., Ltd., Seoul (KR)

( * ) Notice: Subject to any disclaimer, the term of this patent is extended or adjusted under 35 U.S.C. 154(b) by 18 days.

(21) Appl. No.: 13/144,083

(22) PCT Filed: Jul. 23, 2009

(86) PCT No.: PCT/KR2009/004112

§ 371 (c)(1),
(2), (4) Date: Jul. 11, 2011

(87) PCT Pub. No.: WO2010/079872

PCT Pub. Date: Jul. 15, 2010

(65) Prior Publication Data

US 2011/0265422 A1 Nov. 3, 2011

(30) Foreign Application Priority Data

Jan. 12, 2009 (KR) ..... 10-2009-0002293

(51) Int. Cl.
*E04C 5/08* (2006.01)

(52) U.S. Cl.
USPC ..... 52/223.8; 52/223.14; 52/252; 52/334; 52/837; 52/841; 52/745.13

(58) Field of Classification Search ..... 52/223.8, 52/223.1, 223.13, 223.14, 251, 252, 333, 52/334, 836, 837, 838, 841, 745.13
See application file for complete search history.

(56) References Cited

U.S. PATENT DOCUMENTS

| | | | | |
|---|---|---|---|---|
| 3,141,531 | A * | 7/1964 | Montgomery | 52/634 |
| 3,263,387 | A * | 8/1966 | Simpson | 52/634 |
| 4,115,971 | A * | 9/1978 | Varga | 52/334 |
| 4,416,099 | A * | 11/1983 | Fiergolla et al. | 52/319 |
| 8,028,493 | B2 * | 10/2011 | Holmes et al. | 52/837 |
| 2008/0282644 | A1 * | 11/2008 | Hong et al. | 52/847 |
| 2011/0225927 | A1 * | 9/2011 | Kim et al. | 52/835 |

FOREIGN PATENT DOCUMENTS

KR 10-0808057 2/2008

* cited by examiner

*Primary Examiner* — Brian Glessner
*Assistant Examiner* — Adriana Figueroa
(74) *Attorney, Agent, or Firm* — Jianq Chyun IP Office

(57) ABSTRACT

A steel composite beam is manufactured by T-shaped steel, inverse T-shaped steels installed at opposite ends of the T-shaped steel, and vertical stiffeners installed on the inverse T-shaped steels. A method for manufacturing a composite beam using T-shaped steel and a method of constructing a structure using the same are capable of using less steel and minimizing dead weight of the composite beam compared to a steel composite beam having the same cross section and depth, and designing a cross section of the composite beam in an efficient and economical manner due to the pre-stress caused by tendons, providing easy connection with column members on the basis of length, providing efficient construction, easy management, and convenient construction for ceilings and finishing equipment due to light dead weight.

10 Claims, 12 Drawing Sheets

METHOD FOR MANUFACTURING A COMPOSITE BEAM USING T-TYPE STEEL AND METHOD FOR CONSTRUCTING A STRUCTURE USING THE SAME

TECHNICAL FIELD

The present invention relates to a method of manufacturing a composite beam and a method of constructing a structure using the same, and more particularly to a method of manufacturing a composite beam using T-shaped steel, in which the T-shaped steel is prepared by cutting the web of I-shaped steel into the same T-shaped steels and combining casing concrete to around a lower portion of the T-shaped steel to additionally introduce pre-stress into the casing concrete, and a method of constructing a structure using the same.

BACKGROUND ART

Beams used for buildings have been manufactured by various methods. For example, steel beams, pre-stressed concrete (PSC or PC) beams, or steel composite beams obtained by combining steel and concrete have been used.

FIG. 1 shows an example where an I-shaped steel beam 20 is installed between steel columns 10 at opposite ends thereof using splice beams 11, and then slab concrete 30 is cast and cured on the top of the I-shaped steel beam 20, which is considered as showing a most typical method of constructing a slab using a beam for a building.

However, since this I-shaped steel beam 20 is somewhat expensive, considering the high price of steel plate nowadays, it is rather uneconomical.

Particularly, in connection with a composite beam made by combination of steel and concrete, a sandwich composite beam 40 is shown in FIGS. 2 and 3.

The sandwich composite beam 40 of FIG. 2 is composed of lateral section-beams 41 spaced apart from each other in parallel and concrete 42 filled between the lateral section-beams 41. To cast the concrete 42, a lower support plate 43 placed on lower inner flanges of the lateral section-beams 41 is provided. The sandwich composite beam 40 of FIG. 3 is composed of the lateral section-beams 41 that are H-shaped steels spaced apart from each other in parallel, the concrete 42 filled between the lateral section-beams 41, tendons 44 buried in the concrete 42, and the lower support plate 43 placed on lower inner flanges of the lateral section-beams 41 in order to cast the concrete 42.

However, due to its excessive use of the section-beams 41 and a fire-proof covering, from an economic standpoint, this sandwich composite beam 40 is difficult to adopt. In a typical building, H-shaped steels are mainly used for framework. To connect the sandwich composite beam 40 with the H-shaped steel, some means of sufficiently securing connections between heterogeneous materials, i.e., between the steel of the H-shaped steel and the concrete of an end face of the sandwich composite beam, is required.

It is pointed out as a problem that this joining means inevitably reduces constructability, safety, and economy compared to a method of bolting a steel member (steel column) and another steel member (I-shaped steel beam) together as shown in FIG. 1. And, the dead weight of the composite beam is considerably increased because the concrete 42 fills the entire space between the section-beams 41.

Furthermore, since connecting numerous sandwich composite beams 40 to each other requires separate joining means, the connecting work also has a problem in that constructability is inevitably and severely reduced.

A different composite beam has been suggested, which has a honeycomb structure capable of installing pipe members including pipes for facilities on a web thereof. In the composite beam with the honeycomb structure, a steel sheath having an I-shaped cross section is manufactured, and its interior is filled with concrete. Here, web through-holes are formed in a web of the steel sheath. Thereby, the composite beam having the honeycomb structure has an advantage in that the pipe members including pipes for facilities can be installed in the through-holes. However, the composite beam having the honeycomb structure has a problem in that it requires a great deal of welding and somewhat complicated manufacturing, which also results in poor economic efficiency. When the composite beam having the honeycomb structure is installed between H-shaped steels, a joint between the steel of the H-shaped steel and the concrete of the end face of the composite beam also has a fundamental problem in that a separate joining means is required.

DISCLOSURE

Technical Problem

Accordingly, the present invention has been made in an effort to solve the problems occurring in the related art.

An objective of the present invention is to provide a method of manufacturing a composite beam using T-shaped steel that is more economical, enables easier connection with columns such as H-shaped steels without increasing dead weight, enables a long span for the same type, improves applicability due to size, enables easy connection of a plurality of composite beams to each other without requiring additional facilities and subsidiary materials, and sufficiently ensures manufacturability, constructability, and economy, and a method of constructing a structure using the same.

Another objective of the present invention is to provide a method of manufacturing a composite beam using T-shaped steel that can reduce a pre-stressed concrete (PC) cross section and the number of tendons due to the formation of a lower tensile flange and the prevention of bending or buckling of a cut portion of a honeycomb structure beam, increase allowable compressive stress, make up for a compression transfer surface of a honeycomb portion and its resultant site where lamellar tearing may occur, ensure longitudinal integrality and safety with respect to the PC cross section, and transferring transverse stress to promote structural stability, and a method of constructing a structure using the same.

Technical Solution

In order to achieve the above objectives, according to one aspect of the present invention, there is provided a method of manufacturing a composite beam using T-shaped steel, the method including: cutting a web of I-shaped steel in a longitudinal direction to prepare a plurality of T-shaped steels having upper and lower flanges in such a manner that a cutting line extends from a middle portion of the web at each of opposite ends of the I-shaped steel in an inward direction, runs in an upward inward direction, runs from an upper portion of the web below an upper flange of the I-shaped steel in a horizontal direction, runs toward a lower portion of the web in a downward inward direction, and runs from the lower portion of the web above the lower flange of the I-shaped steel in a horizontal direction to be continuously formed in a toothed shape, wherein one of opposite ends of each of the T-shaped steels having the upper and lower flanges is cut to a predetermined length from its end face in an inward direction, and first teeth protruding upwards from the cut ends of the upper and lower flanges of the T-shaped steels are cut to a depth of the web of the T-shaped steel so that the T-shaped steels having the upper and lower flanges have the same shape;

integrating inverse T-shaped steel into lower surfaces of the webs of the opposite ends of each T-shaped steel to form I-shaped cross sections at the opposite ends of each T-shaped steel, and fixing vertical stiffeners to opposite sides of the web of the I-shaped cross section; and casting casing concrete along the web between the opposite vertical stiffeners of each T-shaped steel so that the opposite ends of each T-shaped steel are exposed as a steel on outer sides of the opposite vertical stiffeners.

The method may further include forming studs on opposite sides of a lower portion of the web of the T-shaped steel in order to improve combination performance and rigidity with respect to the casing concrete, and arranging reinforcing bars.

The casing concrete may be cast to a height at which through-holes are exposed from the web of the T-shaped steel.

The method may further include, before the casing concrete is cast, installing tendons between the vertical stiffeners, and after the casing concrete is cast, post-tensioning the tendons, anchoring the tendons to the vertical stiffeners, and pre-stressing the casing concrete.

Each vertical stiffener may have an L-shaped cross section with a vertical portion and a horizontal portion, and the horizontal portion may include a plurality of through-holes in which the tendons are inserted and anchored.

The method may further include disposing angle stiffeners in parallel on opposite sides of a lower portion of the web of the T-shaped steel in a longitudinal direction in order to improve combination performance and rigidity with respect to the casing concrete, and arranging reinforcing bars.

Here, the casing concrete may be cast to a height at which through-holes are exposed from the web of the T-shaped steel.

The method may further include, before the casing concrete is cast, installing tendons between the vertical stiffeners, and after the casing concrete is cast, post-tensioning the tendons, anchoring the tendons to the vertical stiffeners, and pre-stressing the casing concrete.

According to another aspect of the present invention, there is provided a method of constructing a structure using a composite beam based on T-shaped steel, the method including: connecting at least two composite beams based on the T-shaped steel produced in a factory in a longitudinal direction at a construction site, and installing the connected composite beam so that opposite ends of the connected composite beam are fixed to end structures including columns;

post-tensioning tendons installed before the casing concrete is cast to introduce pre-stress into the casing concrete after the casing concrete is cast; and casting and curing slab concrete on an upper surface of the composite beams, each of which has the pre-stressed T-shaped steel.

The casing concrete may be cast to a height at which through-holes are exposed from the web of the T-shaped steel having the lower or upper flange, and pipe members including pipes for facilities may be further installed in the exposed through-holes.

Advantageous Effects

According to the present invention, the following effects can be obtained.

First, it is possible to reduce an amount of steel used compared to a composite beam having the same cross section and size, and provide an efficient economical cross-sectional design due to the pre-stress caused by tendons.

Second, opposite ends of the composite beam are configured to be exposed in the form of I-shaped steel, so that it is possible to easily connect the opposite ends of the composite beam to H-shaped steel columns, and promote convenience and stability of construction.

Third, it is possible to cope with variation in height of the casing concrete cast on a lower portion of the T-shaped steel by maintaining the T-shaped steel as it is and adjusting a depth of inverse T-shaped steel, so that the composite beam can be manufactured to cope with various standards (e.g. heights) of the casing concrete.

Fourth, the dead weight of the entire composite beam can be reduced by using the pre-stressed casing concrete along with the steel.

Fifth, when vertical stiffeners are installed on the inverse T-shaped steels formed at the opposite ends of the composite beam, the segmented composite beams can be easily connected to each other, so that their transportability and constructability can be improved. The vertical stiffener can effectively resist local stress and shear stress occurring at the opposite ends of the composite beam, so that it is possible to improve structural stability of the composite beam.

Sixth, when the through-holes are formed in the web of the composite beam above the casing concrete by the cut T-shaped steel, the composite beam can be used in the same manner as the composite beam having a honeycomb structure, so that it is possible to ensure efficient ceiling finishing. The depth of the T-shaped steel composite beam can be reduced by adjusting the depth of the casing concrete.

Seventh, since a pair of angle stiffeners are mounted to face each other on a lower end of the web of the T-shaped steel, the formation of a lower tensile flange and the prevention of bending or buckling of a cut portion of the honeycomb-structured beam enable reduction of the PC cross section and the number of tendons and increase of allowable compressive stress. Further, angle stiffeners make up for a compression transfer surface of the honeycomb portion and its resultant site where the lamellar tearing may occur, can ensure longitudinal integrality and safety with respect to the PC cross section, and can transfer transverse stress to ensure structural stability.

DESCRIPTION OF SYMBOLS OF MAIN PARTS IN DRAWINGS

Figure 1:
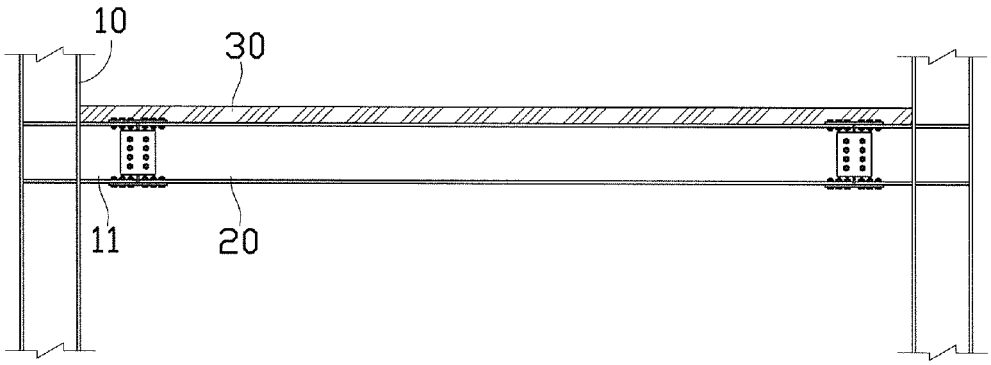
FIG. 1 (RELATED ART)
FIG. 1 is a cross-sectional view of a conventional steel framework.
Figure 2:
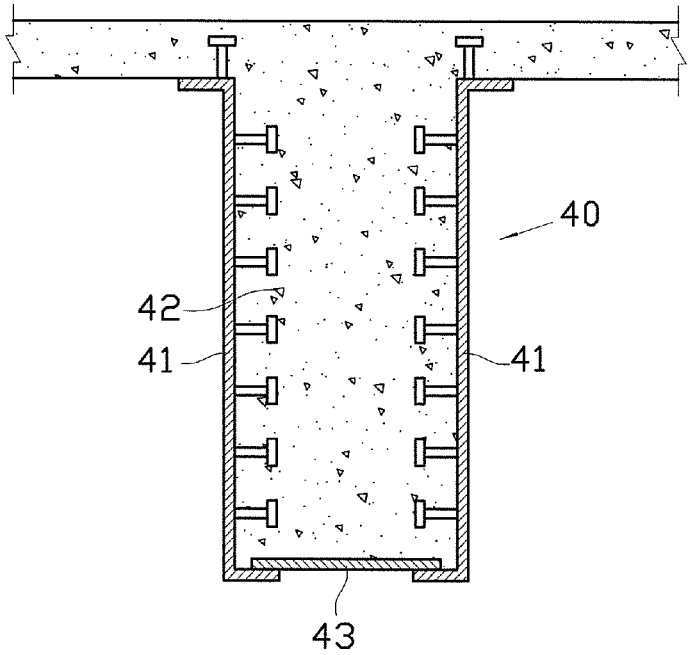
FIG. 2 (RELATED ART)
FIGS. 2 and 3 are cross-sectional views of a conventional sandwich composite beam.
Figure 3:
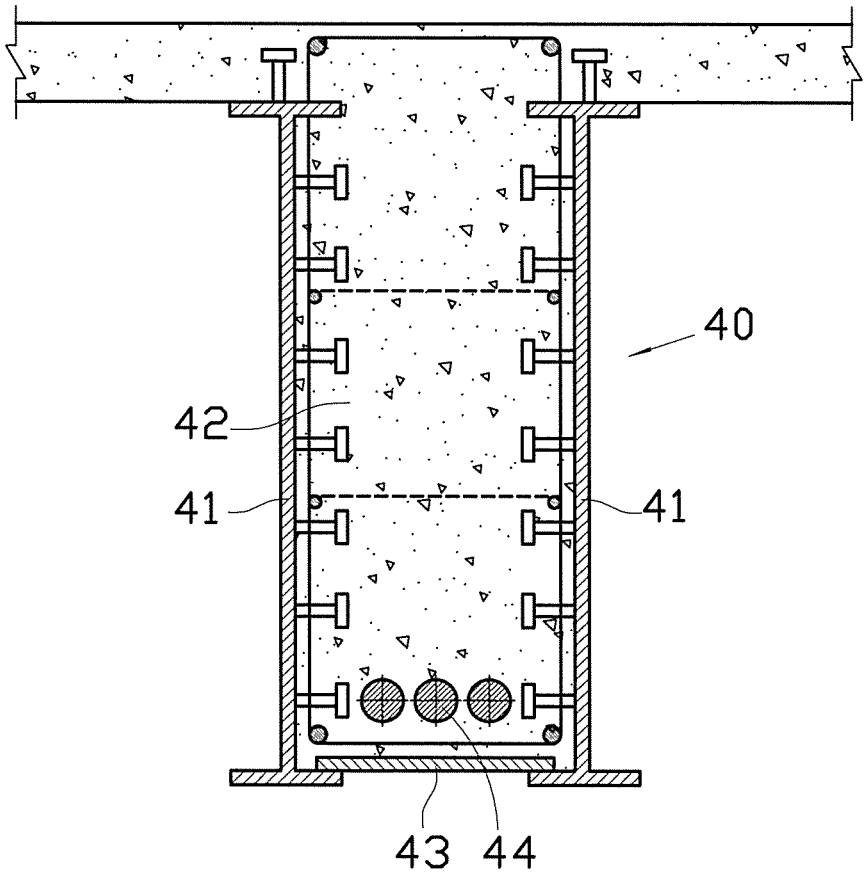
FIG. 3 (RELATED ART)

100: I-shaped steel
110: upper flange of the I-shaped steel
120: web of the I-shaped steel
130: lower flange of the I-shaped steel
200, 200*a*, 200*b*: T-shaped steel having upper flange
220: cut web of each end of the T-shaped steel
300, 300*a*, 300*b*: T-shaped steel having lower flange
400, 400*a*, 400*b*: inverse T-shaped steel
500, 500*a*, 500*b*: vertical stiffener
510: vertical plate of the vertical stiffener
520: horizontal plate of the vertical stiffener
521: through-hole
550: reinforcing
600: tendon
700, 700*a*, 700*b*: casing concrete
800: stud
900: pipe member
920: angle stiffener

BEST MODE

According to the present invention, there is provided a method of manufacturing a composite beam using T-shaped steel, the method including: cutting a web of I-shaped steel in a longitudinal direction to prepare a plurality of T-shaped steels having upper and lower flanges in such a manner that a cutting line extends from a middle portion of the web at each of opposite ends of the I-shaped steel in an inward direction, runs in an upward inward direction, runs from an upper portion of the web below an upper flange of the I-shaped steel in a horizontal direction to be continuously formed in a toothed shape, runs toward a lower portion of the web in a downward inward direction, and runs from the lower portion of the web above the lower flange of the I-shaped steel in a horizontal direction, wherein one of opposite ends of each of the T-shaped steels having the upper and lower flanges is cut to a predetermined length from its end face in an inward direction, and first teeth protruding upwards from the cut ends of the upper and lower flanges of the T-shaped steels are cut to a depth of the web of the T-shaped steel so that the T-shaped steels having the upper and lower flanges have the same shape, integrating inverse T-shaped steel into lower surfaces of the webs of the opposite ends of each T-shaped steel to form I-shaped cross sections at the opposite ends of each T-shaped steel, and fixing vertical stiffeners to opposite sides of the web of the I-shaped cross section, and casting casing concrete along the web between the opposite vertical stiffeners of each T-shaped steel so that the opposite ends of each T-shaped steel are exposed as a steel on outer sides of the opposite vertical stiffeners.

MODE FOR INVENTION

Reference will now be made in greater detail to an exemplary embodiment of the invention, an example of which is illustrated in the accompanying drawings.

For more clear and easy description of the invention, a most exemplary embodiment of the invention will be described with reference to the accompanying drawings. Since the exemplary embodiment of the invention can be modified in various ways, the scope of the invention is not limited to the embodiment described below.

Figure 4:
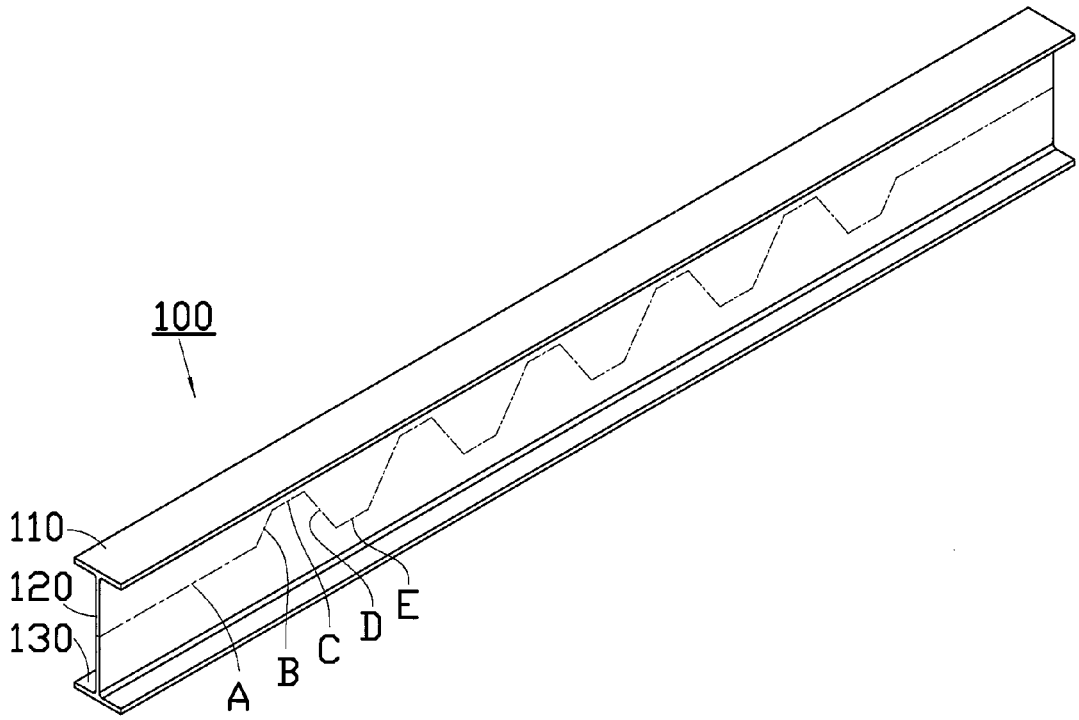
FIGS. 4, 5 and 6 are process views showing a cutting method of T-shaped steel manufactured according to the present invention.
Figure 5:
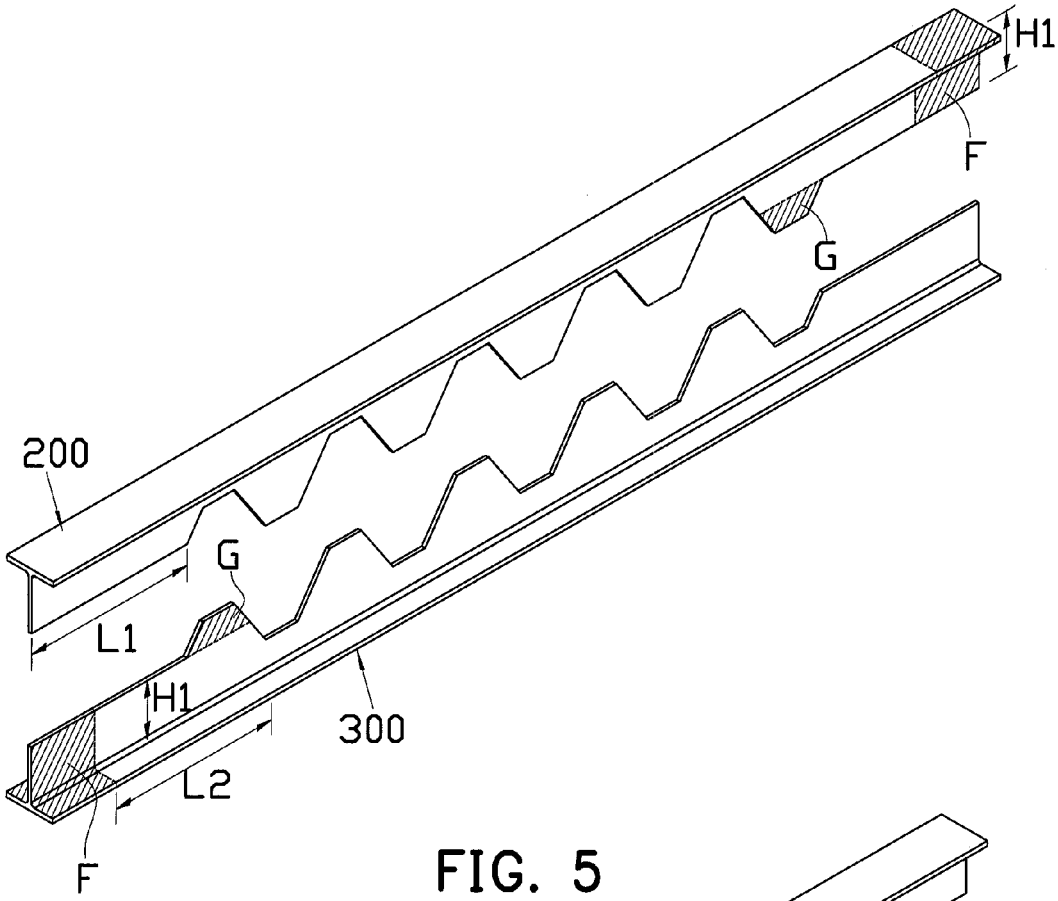
Figure 6:
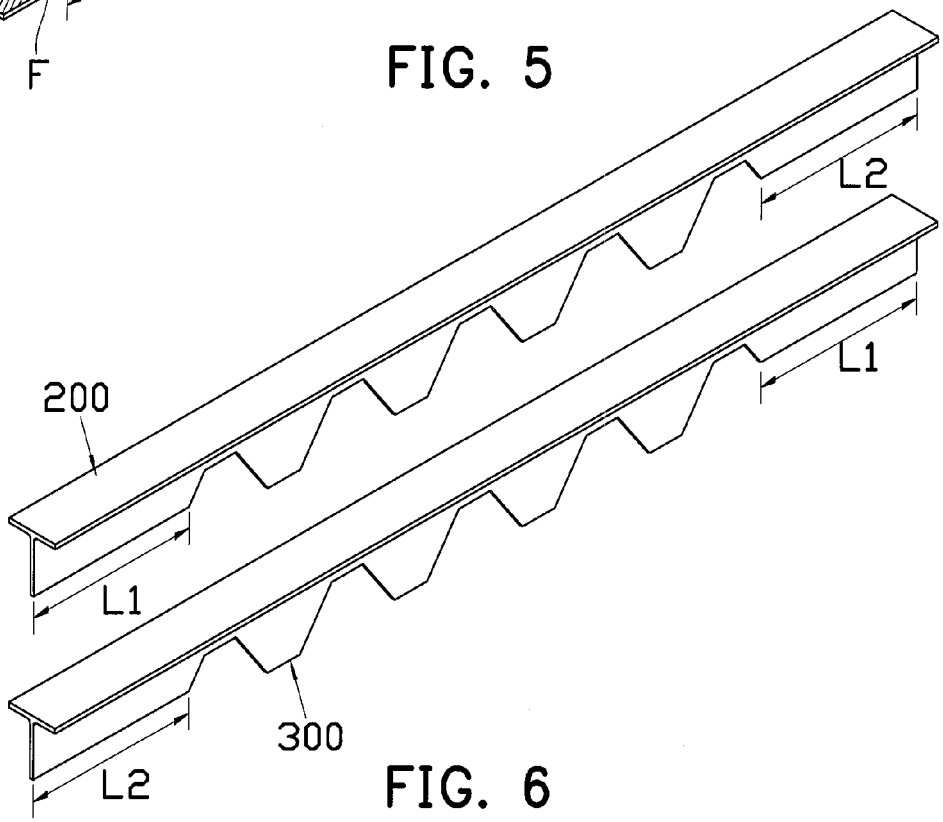

FIGS. 4, 5, 6 sequentially illustrate a method of manufacturing T-shaped steel according to the invention.

First, in FIG. 4, I-shaped steel 100 is prepared.

The I-shaped steel 100 uses an existing rolled steel product in which an upper flange 110, a web 120, and a lower flange 130 are integrally formed, as opposed to built-up I-shaped steel made by machining and welding steel plates.

In detail, the steel plate is cut into three parts, i.e. the upper flange 110, the web 120, and the lower flange 130, and these parts are welded into the I-shaped steel 100 having an I-shaped cross section. In comparison with this I-shaped steel 100, the I-shaped steel 100 of the invention can reduce manufacturing cost.

For example, the I-shaped steel 100 may use structural rolled steel having a standard of 50H-700(depth)×300 (width)×13×24.

The I-shaped steel 100 is manufactured into two T-shaped steels 200 and 300 by cutting its web 120.

This cutting method cuts the web 120 of the I-shaped steel 100 in a longitudinal direction in such a manner that a cutting line extends from the middle portion of the web 120 at each of opposite ends of the I-shaped steel 100 in an inward direction (line A), runs from the extending end of line A in an upward inward direction (line B), runs from an upper portion of the web 120 below the upper flange 110 in a horizontal direction (line C), runs toward a lower portion of the web 120 in a downward inward direction (line D), and runs from the lower portion of the web 120 above the lower flange 130 in a horizontal direction (line E). Thereby, the cutting line is continuously formed in a toothed shape by repetition of the lines B to E, and thus T-shaped steel 200 having an upper flange and T-shaped steel 300 having a lower flange are provided as shown on upper and lower sides of FIG. 5.

In the present invention, the two T-shaped steels 200 and 300 can be obtained from one I-shaped steel 100, and each of the T-shaped steels 200 and 300 is used for one composite beam. As a result, two composite beams can be manufactured.

Thus, it can be seen that the present invention can reduce an amount of steel compared to the composite beam that uses one I-shaped steel 100.

This relies on the premise that the T-shaped steel 200 having the upper flange, and the T-shaped steel 300 having the lower flange, should be cut in the same shape. To this end, in the present invention, parts of the T-shaped steels 200 and 300 having the upper and lower flanges shown in FIG. 5 are additionally cut, and the cut portions are indicated by oblique lines (portions F and G).

That is, one of opposite ends of each of the T-shaped steels 200 and 300 having the upper and lower flanges is cut to a predetermined length from its end face in an inward direction (portion F), and the first tooth (portion G) protruding upwards from the middle portion of the web is cut to a depth H1 of the web. Thereby, when the T-shaped steel 300 having the lower flange and cut as in FIG. 6 is turned upside down, it can be manufactured in the same shape as the T-shaped steel 200 having the upper flange.

Here, the T-shaped steels 200 and 300 having the upper and lower flanges are each formed so that a web length L1 of one end thereof is equal to a web length L2 of the other end thereof which is partially cut along with the first tooth.

Figure 7:
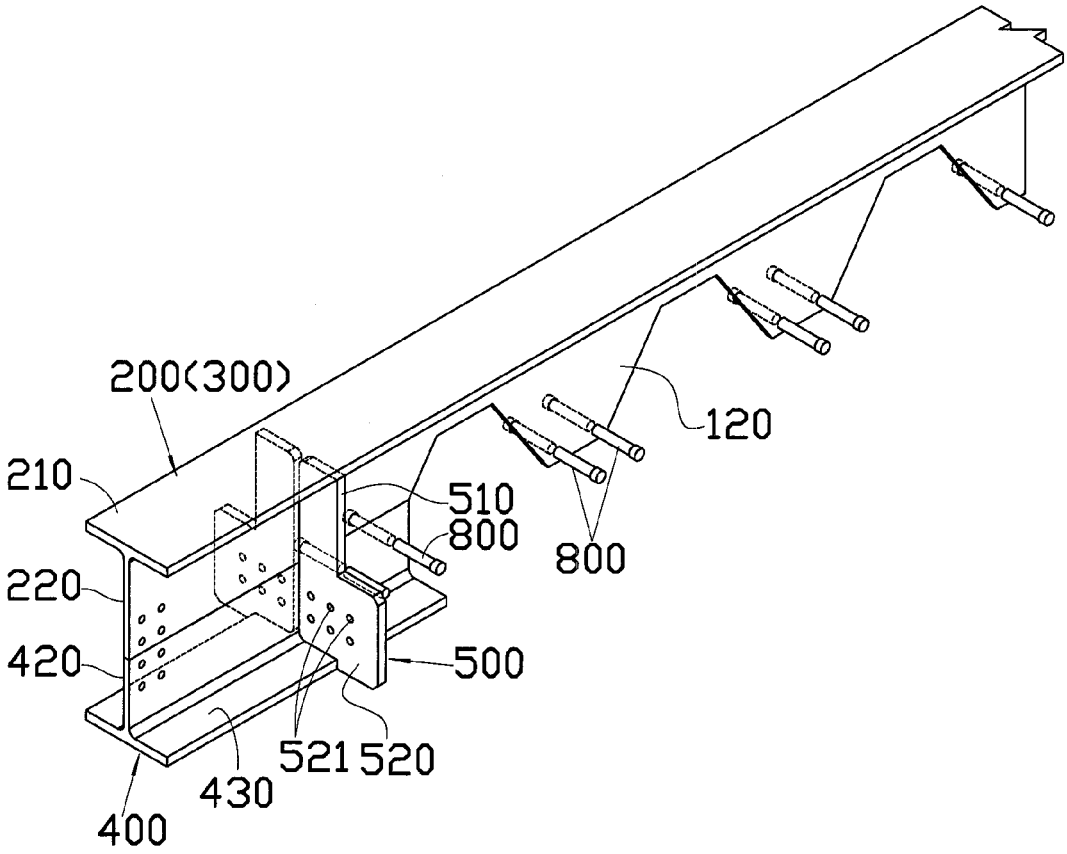
FIGS. 7, 8 and 9 are an assembled perspective view, a top view, and a partially extracted perspective view of T-shaped steel and inverse T-shaped steel in a composite beam according to the present invention, respectively.
Figure 8:
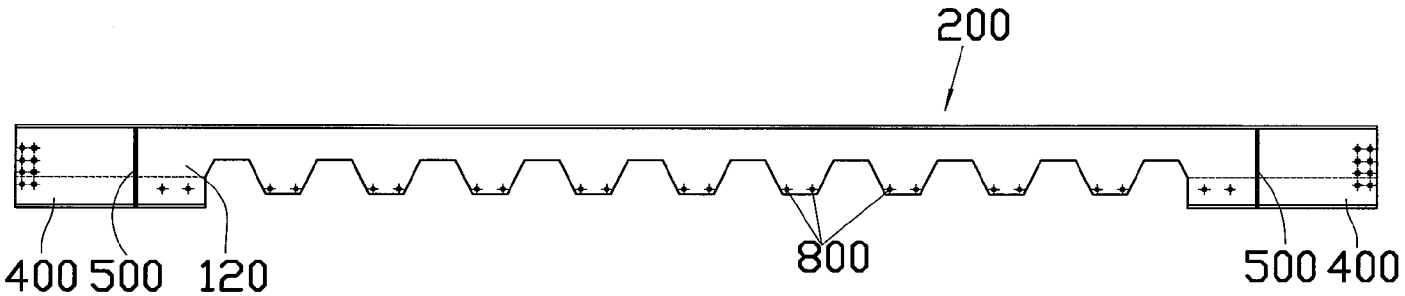
Figure 9:
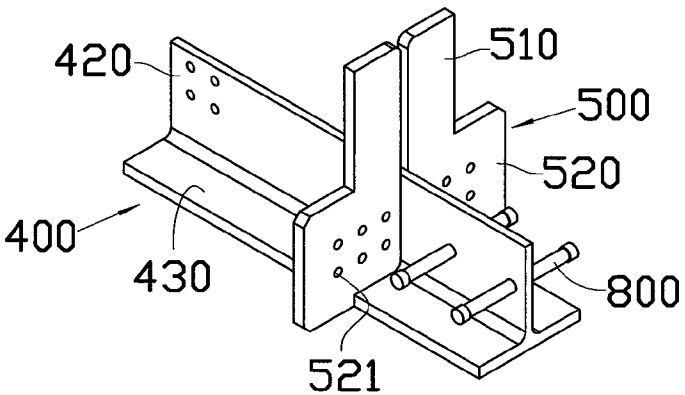
Figure 10:
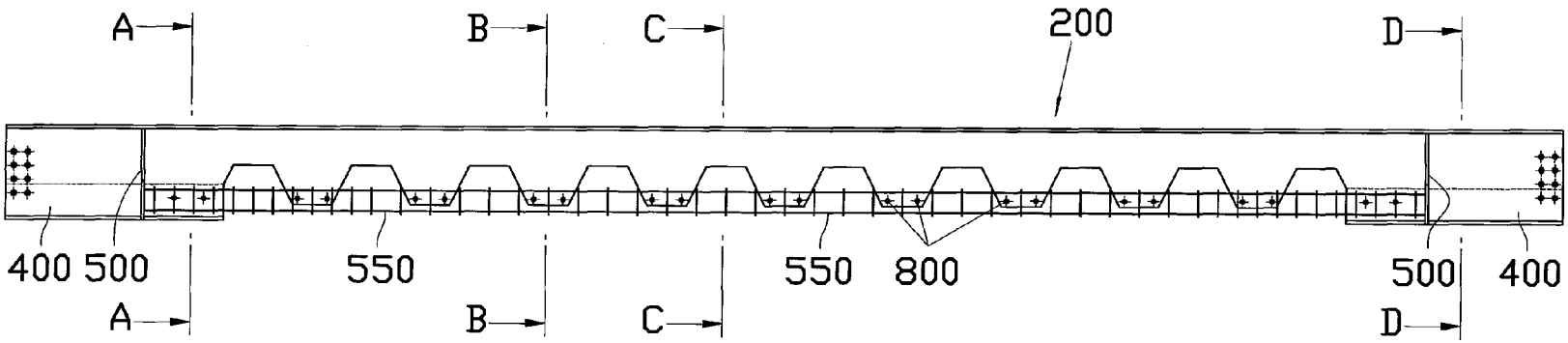
FIG. 10 is a top view of studs and reinforcing installed in a lower portion of the T-shaped steel in the composite beam according to the present invention.
Figure 11:
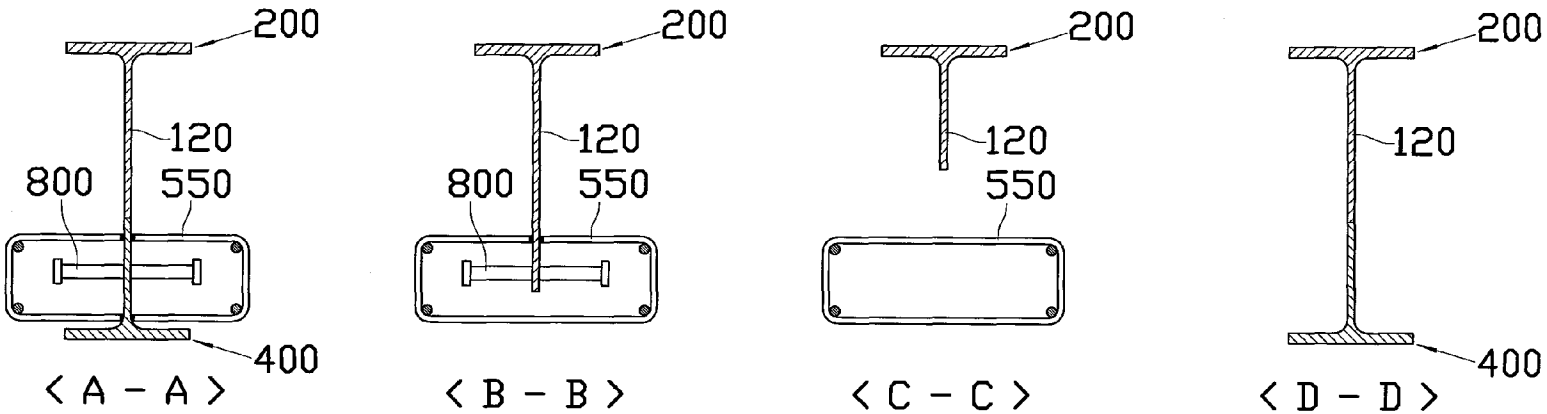
FIG. 11 shows studs and reinforcing installed in the lower portion of the T-shaped steel of FIG. 10 in cross-sectional views taken along lines A-A, B-B, C-C, and D-D.

When the T-shaped steels 200 and 300 having the upper and lower flanges cut in this way are prepared, inverse T-shaped steel 400 is welded to the opposite ends thereof as shown in FIGS. 7, 8 and 9. In the present invention, the T-shaped steels 200 and 300 having the upper and lower flanges are equally machined. However, for the sake of clarity, the following description will focus on the T-shaped steel 200 having the upper flange with reference to the accompanying drawings.

As shown in FIG. 7, first, a web 420 of the inverse T-shaped steel 400 is butted on and welded to the cut web 220 of each end of the T-shaped steel 200, so that these webs are formed integrally with each other. Thus, it can be seen that the opposite ends of the T-shaped steel 200 are formed in an I-shaped cross section.

Here, the cut web 220 of each end of the T-shaped steel 200 is formed so as to have the same length as the web 420 of the inverse T-shaped steel 400.

Further, a depth of the web 420 may be adjusted as desired. The depth of the web 420 may be preset depending on a height of casing concrete 700 cast in the future, so that a size of the composite beam can be freely adjusted. However, the T-shaped steel 200 is maintained without change. As a result, it is possible to more easily prepare for a cross-sectional standard based on the size of the composite beam.

In addition, the web 420 of the inverse T-shaped steel 400 is provided with studs 800 extending from opposite sides of an inner portion thereof in a horizontal direction, and the web 220 of the T-shaped steel 200 is also provided with studs 800. Thereby, the capability of combining with the casing concrete 700 cast in the future is increased. Further, the T-shaped steel 200 and the inverse T-shaped steel 400 may be provided with vertical stiffeners 500.

Each vertical stiffener 500 is a steel plate that is vertically welded between a lower surface of the upper flange 210 of the T-shaped steel 200 and an upper surface of the lower flange 430 of the inverse T-shaped steel 400, as shown in FIG. 9. The vertical stiffener 500 is made up of a vertical plate 510 and a horizontal plate 520, and may be formed in an overall L-shape. However, the shape of the vertical stiffener 500 may be properly modified.

The horizontal plate 520 may be provided with a plurality of through-holes 521 so as to allow tendons 600, which will be described below, to pass through the through-holes 521.

Each vertical stiffener 500 is disposed at an approximately middle portion of each inverse T-shaped steel 400, so that the vertical stiffeners 500 of the respective inverse T-shaped steels 400 are opposite to each other.

As described below with reference to FIG. 15, the casing concrete 700 is cast on an inner side between the opposite vertical stiffeners 500, but it is not cast on an outer side of the vertical stiffener 500 so that the outer side of the vertical stiffener 500 can be exposed to the outside as it is.

It is shown in FIG. 9 that the vertical stiffeners 500 can be installed in advance on the inverse T-shaped steel 400 along with the studs 800. It can be seen from this installation method that the vertical stiffeners 500 and the studs 800 can be simultaneously installed only by installing the inverse T-shaped steel 400 on the T-shaped steel 200.

Furthermore, it can be seen that width and height of the vertical stiffener 500 can be varied according to use and can easily cope with, for instance, a width of the casing concrete 700.

Reinforcing 550 is arranged to cast the casing concrete 700 on the inner side between the opposite vertical stiffeners 500.

This reinforcing 550 is made to surround the studs 800 on the inner side between the opposite vertical stiffeners 500.

Figure 12:
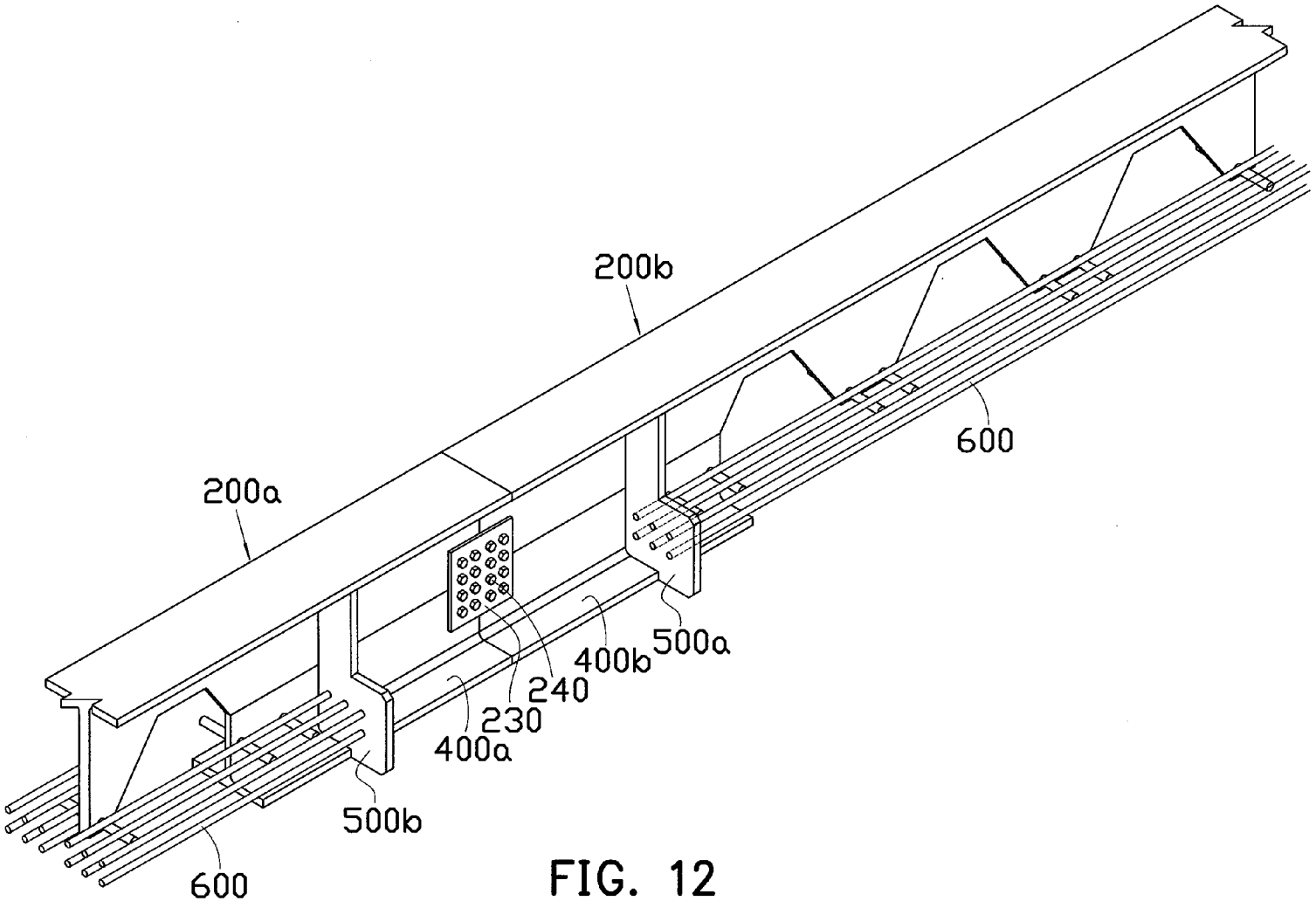
FIG. 12 is a perspective view of tendons installed in the composite beam according to the present invention.

Next, as shown in FIG. 12, both the T-shaped steels 200*a* and 200*b*, and the inverse T-shaped steels 400*a* and 400*b*, both of which are described above, can be connected to each other in a longitudinal direction using splice plates 230, bolts 240 and nuts, and tendons 600 are installed.

Thus, according to the present invention, it can be seen that, since the members including the T-shaped steels 200*a* and 200*b* can be maintained in the state where the opposite ends thereof are exposed by the vertical stiffeners 500*a* and 500*b*, the members can be simply and easily connected to each other using the splice plates 230 and the bolts 240.

That is, since the through-holes 521 are formed in the vertical stiffeners 500*a* and 500*b*, the inverse T-shaped steels 400*a* and 400*b* installed on the T-shaped steels 200*a* and 200*b* allow the tendons 600 such as pre-stressed concrete (PC) steel strands to be arranged in advance in a horizontal direction using these through-holes, and then be post-tensioned and anchored to the vertical stiffeners 500*a* and 500*b* using a separate pre-stressing unit.

Thus, according to the present invention, it can be seen that a plurality of T-shaped steels 200*a* and 200*b* are very easily connected to each other in a longitudinal direction. When connected, the T-shaped steels and the inverse T-shaped steels are connected only by joining the steel members. As such, it can be seen that, heterogeneous materials (steel and concrete) are not joined, the joining or connecting performance of the T-shaped steels can be sufficiently ensured. Further, it can be seen that the construction and quality management are very easy since connecting means such as the bolts 240 and the splice plates 230 are used.

Figure 13:
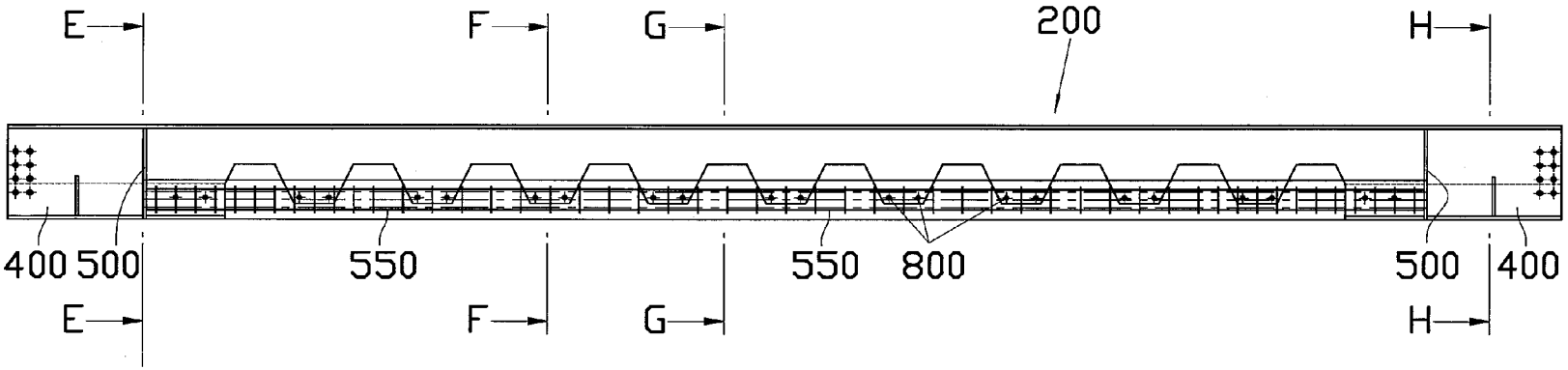
FIG. 13 is a top view of studs, tendons, reinforcing, and casing concrete constructed in the lower portion of the T-shaped steel in the composite beam according to the present invention.
Figure 14:
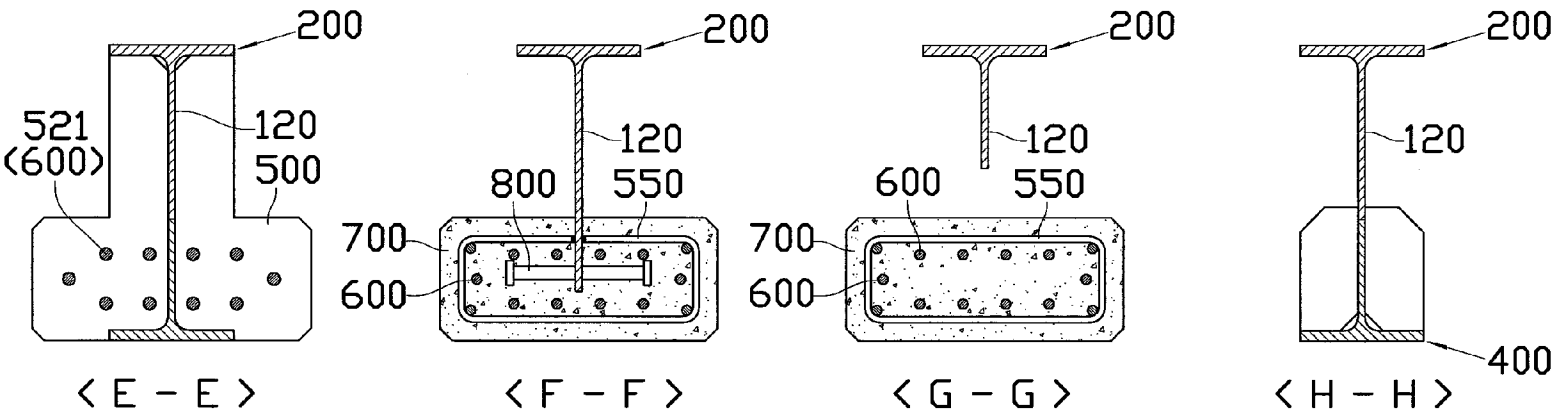
FIG. 14 shows the studs, tendons, reinforcing, and casing concrete constructed in the lower portion of the T-shaped steel in the composite beam according to the present invention in cross-sectional views taken along lines E-E, F-F, G-G, and H-H of FIG. 13.

It is shown in FIGS. 13 and 14 that the reinforcing 550 and the tendons 600 are installed on the inner side between the opposite vertical stiffeners 500 along with the studs 800. It can be seen from this structure, shown in FIG. 14, that the tendons 600 and the studs 800 are surrounded by the reinforcing 550.

Figure 15:
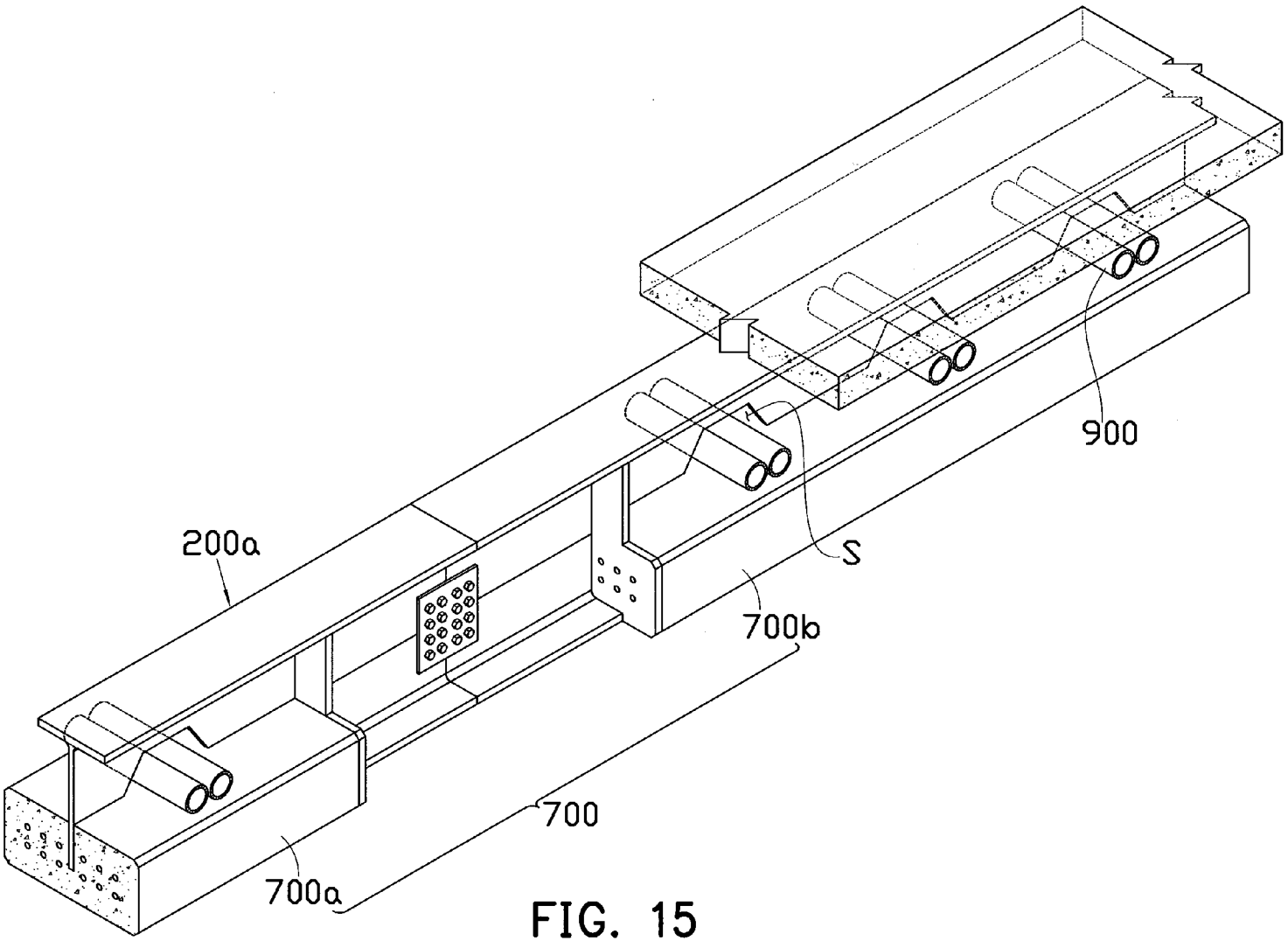
FIG. 15 is a perspective view showing the casing concrete cast on the composite beam according to the present invention.

Next, as shown in FIG. 15, the casing concrete 700, 700*a* or 700*b* is cast on the inner side between the opposite vertical stiffeners 500 using a form, which is not shown. It can be seen that, since this casing concrete 700*a* or 700*b* is formed between the vertical stiffeners 500*a* and 500*b*, the vertical stiffeners 500*a* and 500*b* can act as a kind of side form, and thus form fabrication and construction costs can be reduced. Further, the capability of combining with the casing concrete can be improved by the studs 800 installed on the T-shaped steel 200 and the inverse T-shaped steel 400.

A height of the cast casing concrete 700*a* or 700*b* is determined so as not to reach the cutting line C of the web 120 of the T-shaped steel 200. Thus, it can be seen that, after the casing concrete 700*a* or 700*b* is cast, through-holes S having a predetermined size can be formed between the upper surface of the casing concrete and the line C.

Thus, it can be seen that the composite beam of the present invention can reduce floor/ceiling depth in a building due to a honeycomb structure that allows the equipment 900 such as plumbing to pass through its web, and make efficient use of a finish ceiling space depth, because finish ceiling equipment such as fire sprinklers can be installed in the ceiling of each story.

Furthermore, compressive pre-stress is designed to be introduced into the casing concrete 700 by post-tensioning and anchoring the tendons 600 to the casing concrete 700, and thus it can be seen that the composite beam can sufficiently ensure flexural rigidity for its size, use less steel compared to other steel beams having the same cross section and size, and provide an efficient, economical cross-sectional design due to the pre-stress caused by the tendons.

In addition, it can be seen that the dead weight of the composite beam is allowed to be reduced by introducing the pre-stress caused by the tendons to efficiently adjust a cross-sectional size of the casing concrete, thereby making it possible to stably manufacture and construct the composite beam.

The composite beam manufactured in this way may be installed, for instance, between the steel columns 10 as shown in FIG. 1, its opposite ends exposed through the inverse T-shaped steels 400 made of steel, so that the composite beam is very easily connected to and installed on a column structure such as H-shaped steel using the simple splice plates 230 and the bolts 240. Thus, it can be seen that this easy connection is because the opposite ends of the composite beam are exposed to the outside through the steel member having the I-shaped cross section by the vertical stiffeners 500 and the inverse T-shaped steels 400.

Thus, when the composite beam of the present invention is installed on the column structure, slab concrete is cast and cured so that the basic construction for the floor of the structure can be completed.

Furthermore, the composite beam of the present invention may be manufactured by preparing the T-shaped steels having the upper and lower flanges with no vertical stiffener, installing the inverse T-shaped steels on the opposite ends of each T-shaped steel, arranging in advance the tendons around the lower flange of the inverse T-shaped steel so that the tendons are buried but the through-holes are formed, casting and curing the casing concrete to a predetermined height so that the T-shaped steel and the inverse T-shaped steel are exposed at the opposite ends of the composite beam, and post-tensioning and anchoring the tendons. Thereby, the composite beam may be manufactured with no vertical stiffener.

Further, although not shown, the cast casing concrete may be cast to a height above the cutting line C of FIG. 4 regardless of the installation of the vertical stiffener, so that the composite beam can be manufactured with no through-hole while allowing the casing concrete to be pre-stressed.

Figure 16:
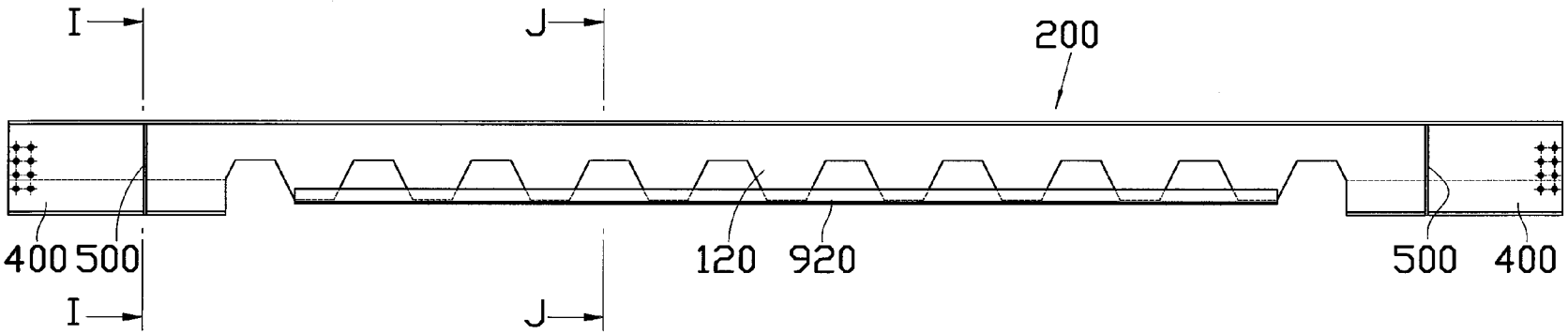
FIG. 16 is a top view of angle stiffeners and reinforcing installed in the lower portion of the T-shaped steel in the composite beam according to the present invention.
Figure 17:
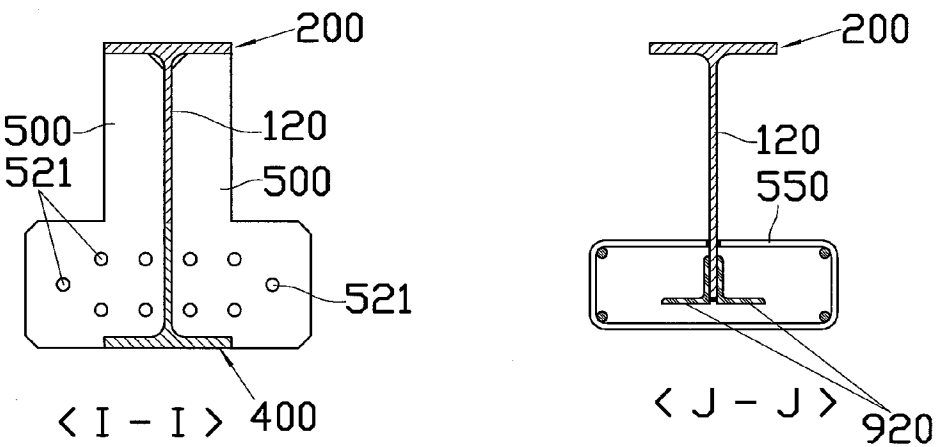
FIG. 17 shows the angle stiffeners and reinforcing installed in the lower portion of the T-shaped steel in the composite beam according to the present invention in cross-sectional views taken along lines I-I and J-J of FIG. 16.
Figure 18:
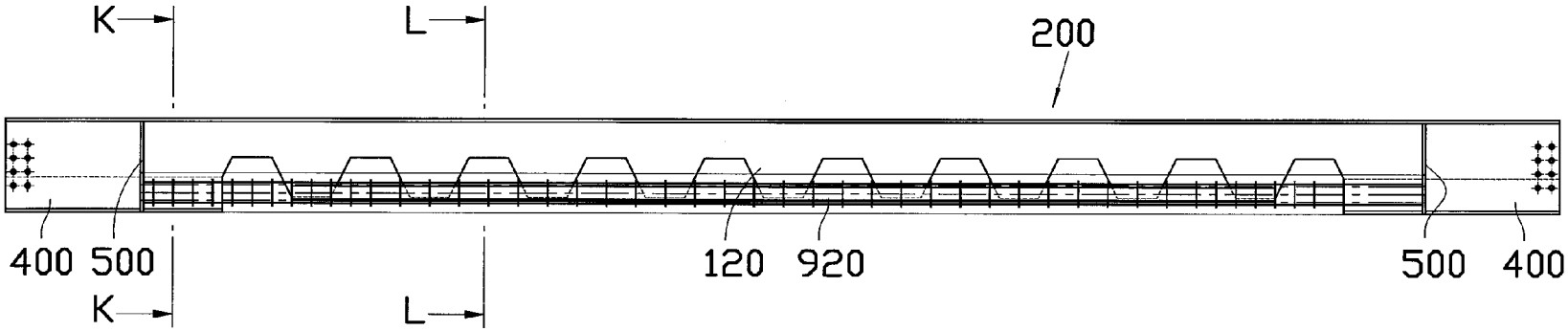
FIG. 18 is a top view of the angle stiffeners, tendons, reinforcing, and casing concrete constructed in the lower portion of the T-shaped steel in the composite beam according to the present invention.

FIGS. 16, 17 and 18 show a structure in which, to improve combination performance and rigidity with respect to the casing concrete 700, angle stiffeners 920 are fixed in parallel on opposite sides of a lower portion of the web 120 of the T-shaped steel 200 in a longitudinal direction, and reinforcing 550 is arranged.

When these angle stiffeners 920 are installed, it is possible to reduce a PC cross section and the number of tendons due to the formation of a lower tensile flange and the prevention of bending or buckling of the cut portion of the honeycomb-structured beam, and to increase allowable compressive stress. Further, the angle stiffeners make up for a compression transfer surface of a honeycomb portion and its resultant site where lamellar tearing may occur, can ensure longitudinal integrality and safety with respect to the PC cross section, and can transfer transverse stress to promote structural stability.

Figure 19:
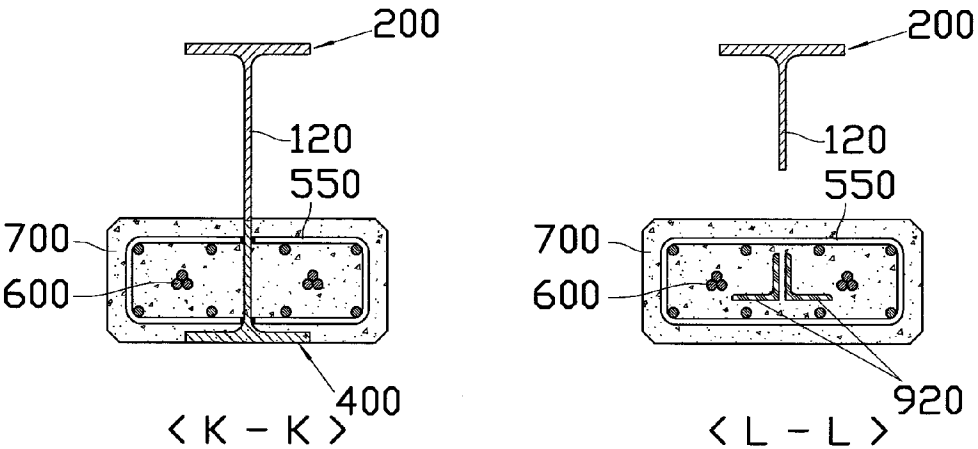
FIG. 19 shows the angle stiffeners, tendons, reinforcing, and casing concrete constructed in the lower portion of the T-shaped steel in the composite beam according to the present invention in cross-sectional views taken along lines K-K and L-L of FIG. 18.

After the angle stiffeners 920 and the reinforcing 550 are provided, the height of the cast casing concrete 700 reaches a height where the through-holes S are exposed from the web 120 of the T-shaped steel 200. As shown in FIGS. 18 and 19, the tendons 600 are installed between the vertical stiffeners 500 before the casing concrete 700 is cast, and are pre-stressed and anchored to the vertical stiffeners 500 after the casing concrete 700 is cast, thereby pre-stressing the casing concrete 700.

As described above, the present invention cuts the web of the I-shaped steel to manufacture the plurality of T-shaped steels, and uses the T-shaped steels for the composite beam having the same cross section and size, so that it is possible to use less steel, and to provide an efficient economical cross-sectional design due to the pre-stress caused by the tendons. The present invention causes the opposite ends of the composite beam to be exposed in the form of I-shaped steel, so that it is possible to easily connect the opposite ends of the composite beam to H-shaped steel columns, and to promote convenience and stability of construction.

It is possible to cope with variation in height of the casing concrete cast on the lower portion of the T-shaped steel by maintaining the T-shaped steel as it is and adjusting the depth of the inverse T-shaped steel, so that the composite beam can be manufactured to cope with various standards (e.g. heights) of the casing concrete. Further, the dead weight of the entire composite beam can be reduced by using the pre-stressed casing concrete along with the steel. When the vertical stiffeners are installed on the inverse T-shaped steels welded to the opposite ends of the composite beam, the segmented composite beams can be easily connected to each other, so that their transportability and constructability can be improved. The vertical stiffener can effectively resist local stress and shear stress occurring at the opposite ends of the composite beam, so that it is possible to improve structural stability of the composite beam.

Further, when the through-holes are formed in the web of the composite beam above the casing concrete by the cut T-shaped steel, the composite beam can be used in the same manner as the composite beam having the honeycomb structure, so that it is possible to ensure efficient ceiling finishing. The depth of the T-shaped steel composite beam can be reduced by adjusting the depth of the cast casing concrete.

Since a pair of angle stiffeners are mounted in parallel on the lower end of the web of the T-shaped steel, the formation of a lower tensile flange and the prevention of bending or buckling of the cut portion of the honeycomb-structured beam enable reduction of the PC cross section and the number of tendons and increase of allowable compressive stress. Further, the angle stiffeners make up for the compression transfer surface of the honeycomb portion and its resultant site where the lamellar tearing may occur, can ensure longitudinal integrality and safety with respect to the PC cross section, and can transfer the transverse stress to promote the structural stability.

Although specific embodiments of the invention have been described with reference to the drawings, the invention is not limited to these specific embodiments. It is apparent to those skilled in the art that a variety of modifications and changes may be made without departing from the scope of the present invention which is intended to be defined by the appended claims. However, it will be understood that the structures based on such modifications and changes of the embodiments clearly fall within the scope of the invention.

The invention claimed is:

1. A method of manufacturing a composite beam using T-shaped steel, the method comprising:

cutting a web of I-shaped steel in a longitudinal direction to prepare a plurality of T-shaped steels having upper and lower flanges in such a manner that a cutting line extends from a middle portion of the web at each of opposite ends of the I-shaped steel in an inward direction, runs in an upward inward direction, runs from an upper portion of the web below an upper flange of the I-shaped steel in a horizontal direction, runs toward a lower portion of the web in a downward inward direction, and runs from the lower portion of the web above the lower flange of the I-shaped steel in a horizontal direction to be continuously formed in a toothed shape, wherein one of opposite ends of each of the T-shaped steels having the upper and lower flanges is cut to a predetermined length from its end face in an inward direction, and first teeth protruding upwards from the cut ends of the upper and lower flanges of the T-shaped steels are cut to a depth of the web of the T-shaped steel so that the T-shaped steels having the upper and lower flanges have the same shape;

integrating inverse T-shaped steel into lower surfaces of the webs at each of the opposite ends of each T-shaped steel to form I-shaped cross sections at each of the opposite ends of each T-shaped steel, and fixing vertical stiffeners to opposite sides of the web of the I-shaped cross section; and casting casing concrete along the web between the opposite vertical stiffeners of each T-shaped steel so that the opposite ends of each T-shaped steel are exposed as a steel on outer sides of the opposite vertical stiffeners.

2. The method according to claim 1, further comprising forming studs on opposite sides of a lower portion of the web of the T-shaped steel in order to improve combination performance and rigidity with respect to the casing concrete, and arranging reinforcing bars.

3. The method according to claim 2, wherein the casing concrete is cast to a height at which through-holes are exposed from the web of the T-shaped steel.

4. The method according to claim 3, further comprising, before the casing concrete is cast, installing tendons between the vertical stiffeners, and after the casing concrete is cast, post-tensioning the tendons, anchoring the tendons to the vertical stiffeners, and pre-stressing the casing concrete.

5. The method according to claim 4, wherein each vertical stiffener has an L-shaped cross section with a vertical portion and a horizontal portion, and the horizontal portion includes a plurality of through-holes in which the tendons are inserted and anchored.

6. The method according to claim 1, further comprising disposing angle stiffeners in parallel on opposite sides of a lower portion of the web of the T-shaped steel in a longitudinal direction in order to improve combination performance and rigidity with respect to the casing concrete, and arranging reinforcing bars.

7. The method according to claim 6, wherein the casing concrete is cast to a height at which through-holes are exposed from the web of the T-shaped steel.

8. The method according to claim 7, further comprising, before the casing concrete is cast, installing tendons between the vertical stiffeners, and after the casing concrete is cast, post-tensioning the tendons, anchoring the tendons to the vertical stiffeners, and pre-stressing the casing concrete.

9. A method of constructing a structure using a composite beam based on T-shaped steel, the method comprising:

connecting at least two composite beams based on the T-shaped steel in a longitudinal direction at a construction site, and installing the connected composite beam so that opposite ends of the connected composite beam are fixed to end structures including columns, the composite beam manufactured by:

cutting a web of I-shaped steel in a factory in a longitudinal direction to prepare a plurality of T-shaped steels having upper and lower flanges in such a manner that a cutting line extends from a middle portion of the web at each of opposite ends of the I-shaped steel in an inward direction, runs in an upward inward direction, runs from an upper portion of the web below an upper flange of the I-shaped steel in a horizontal direction, runs toward a lower portion of the web in a downward inward direction, and runs from the lower portion of the web above the lower flange of the I-shaped steel in a horizontal direction, wherein one of opposite ends of each of the T-shaped steels having the upper and lower flanges is cut to a predetermined length from its end face in an inward direction, and first teeth protruding upwards from the cut ends of the upper and lower flanges of the T-shaped steels are cut to a depth of the web of the T-shaped steel so that the T-shaped steels having the upper and lower flanges have the same shape, integrating inverse T-shaped steel into lower surfaces of the webs at each of the opposite ends of each T-shaped steel to form I-shaped cross sections at each of the opposite ends of each T-shaped steel, and fixing vertical stiffeners to opposite sides of the web of the I-shaped cross section, and casting casing concrete along the web between the opposite vertical stiffeners of each T-shaped steel so that the opposite ends of each T-shaped steel are exposed as a steel on outer sides of the opposite vertical stiffeners;

post-tensioning tendons installed before the casing concrete is cast to introduce pre-stress into the casing concrete after the casing concrete is cast; and casting and curing slab concrete on an upper surface of the composite beams, each of which has the pre-stressed T-shaped steel.

10. The method according to claim 9, wherein the casing concrete is cast to a height at which through-holes are exposed from the web of the T-shaped steel having the lower or upper flange, and pipe members including pipes for facilities are further installed in the exposed through-holes.

* * * * *